US009919440B2

(12) United States Patent
Haba

(10) Patent No.: US 9,919,440 B2
(45) Date of Patent: Mar. 20, 2018

(54) RAZOR

(71) Applicant: KAI R&D Center Co., Ltd., Seki-shi (JP)

(72) Inventor: Daisuke Haba, Seki (JP)

(73) Assignee: Kai R & D Center Co., Ltd. (JP)

( * ) Notice: Subject to any disclaimer, the term of this patent is extended or adjusted under 35 U.S.C. 154(b) by 127 days.

(21) Appl. No.: 14/439,025

(22) PCT Filed: Nov. 5, 2013

(86) PCT No.: PCT/JP2013/079817

§ 371 (c)(1),
(2) Date: Apr. 28, 2015

(87) PCT Pub. No.: WO2014/073501

PCT Pub. Date: May 15, 2014

(65) Prior Publication Data

US 2015/0273708 A1 Oct. 1, 2015

(30) Foreign Application Priority Data

Nov. 6, 2012 (JP) ..... 2012-244028

(51) Int. Cl.
*B26B 21/40* (2006.01)
*B26B 21/44* (2006.01)
*B26B 21/22* (2006.01)

(52) U.S. Cl.
CPC ..... *B26B 21/4012* (2013.01); *B26B 21/225* (2013.01); *B26B 21/4025* (2013.01); *B26B 21/44* (2013.01); *B26B 21/443* (2013.01)

(58) Field of Classification Search
CPC ..... B26B 21/225; B26B 21/4012; B26B 21/4025; B26B 21/44; B26B 21/443
See application file for complete search history.

(56) References Cited

U.S. PATENT DOCUMENTS 5,369,885 A 12/1994 Ferraro
6,349,471 B1 2/2002 Gruslin et al.
(Continued)

FOREIGN PATENT DOCUMENTS

CN 1443106 A 9/2003
CN 201427321 Y 3/2010
(Continued)

OTHER PUBLICATIONS

International Search Report for PCT/JP2013/079817, dated Dec. 3, 2013, 1 page.
(Continued)

*Primary Examiner* — Jonathan Riley
*Assistant Examiner* — Liang Dong
(74) *Attorney, Agent, or Firm* — Tarolli, Sundheim, Covell & Tummino LLP

(57) ABSTRACT

In a frame body, a first outer frame portion and a second outer frame portion are connected together by a third outer frame portion and a fourth outer frame portion, which are located on the left side and the right side of the cutting edges in a main body, respectively, so that the main body is surrounded by the outer frame portions. This improves the rigidity of the frame body, thereby stabilizing the shaving plane, which links together the skin contact portion of the first outer frame portion, the cutting edges of the blade bodies, and the skin contact portion of the second outer frame portion.

8 Claims, 8 Drawing Sheets

(56) References Cited

U.S. PATENT DOCUMENTS

| | | | | |
|---|---|---|---|---|
| 7,703,361 | B2 * | 4/2010 | Johnson | B26B 21/44 30/41 |
| 2006/0080837 | A1 | 4/2006 | Johnson et al. | |
| 2008/0256802 | A1 * | 10/2008 | O'Connor | B26B 21/4012 30/50 |
| 2008/0256803 | A1 | 10/2008 | Tucker et al. | |
| 2009/0307908 | A1 | 12/2009 | Nakasuka | |
| 2010/0154222 | A1 | 6/2010 | Nakasuka | |
| 2012/0151772 | A1 * | 6/2012 | Moon | B26B 21/225 30/41 |

FOREIGN PATENT DOCUMENTS

| | | | |
|---|---|---|---|
| GB | 2 471 676 | A | 1/2011 |
| JP | 2005-218797 | A | 8/2005 |
| JP | 2005261544 | | 9/2005 |
| JP | 2009189589 | | 8/2009 |
| JP | 4413628 | B2 | 2/2010 |
| WO | 94/11163 | A1 | 5/1994 |
| WO | 03090983 | A1 | 6/2003 |
| WO | 2007094337 | A1 | 8/2007 |
| WO | 2008053814 | A1 | 8/2008 |

OTHER PUBLICATIONS

International Preliminary Report on Patentability for PCT/JP2013/079817, dated Dec. 3, 2013, pp. 1-5.

Extended European Search Report for Application No. 13852552.2 dated Jun. 1, 2016.

Japanese Office Action for Application No. 2012-244028 dated Aug. 16, 2016.

Chinese Office Action for Application No. 201380056931.7 dated Oct. 21, 2015.

* cited by examiner

RAZOR

RELATED APPLICATIONS

The present invention is a U.S. National Stage under 35 USC 371 patent application, claiming priority to Serial No. PCT/JP2013/079817, filed on 5 Nov. 2013; which claims priority from Japanese Patent Application No. 2012-244028, filed 6 Nov. 2012, the entirety of both of which are incorporated herein by reference.

BACKGROUND OF THE INVENTION

The present invention relates to a razor capable of shaving skin hairs grown on various parts of a body.

A razor head of a razor described in Patent Document 1 includes a main body including blade bodies and a frame body attached to the main body. In the frame body, roller-shaped outer frame portions each including a skin contact portion are provided above and below the cutting edges of the blade bodies, respectively. The main body is located between the skin contact portions of the outer frame portions. When the razor is used, skin hairs grown on any of various parts of the body can be shaved by the blade bodies while a shaving plane of the razor head is guided along the skin surface by the skin contact portions of the outer frame portions.

PRIOR ART DOCUMENTS

Patent Documents

Patent Document 1: Japanese Laid-Open Patent Publication No. 2009-189589

SUMMARY OF THE INVENTION

However, the frame body opens on each of the left side and right side of the cutting edge, which decreases the rigidity of the frame body. Thus, the shaving plane cannot be stabilized, which may result in a failure in smooth guiding of the razor head on the skin surface between the skin contact portions of the outer frame portions and thus degrade the shaving sensation.

Accordingly, it is an objective of this invention to improve the shaving sensation by smooth guiding of a razor head along the skin surface when a razor is used.

To achieve the foregoing objective, the present invention provides a razor that includes a main body including a blade body and a frame body attached to the main body. The frame body includes a first outer frame portion provided below a cutting edge of the blade body, a second outer frame portion provided above the cutting edge, a third outer frame portion and a fourth outer frame portion, which connect the first outer frame portion and the second outer frame portion to each other on a left side and a right side of the blade body, respectively, an opening surrounded by the first to fourth outer frame portions, and skin contact portions each provided on one of the first outer frame portion and the second outer frame portion. The main body is fitted in the opening to be surrounded by the outer frame portions. A shaving plane, which connects the skin contact portion of the first outer frame portion, the cutting edge of the blade body, and the skin contact portion of the second outer frame portion, is provided.

Thus, the shaving plane is stabilized by increasing the rigidity of the frame body. Accordingly, when the razor is used, the razor head is smoothly guided along the skin surface between the skin contact portion of the first outer frame portion and the skin contact portion of the second outer frame portion by the first outer frame portion and the second outer frame portion of the frame body. This improves the shaving sensation.

The main body preferably includes a first inner frame portion positioned below the cutting edge of the blade body and a second inner frame portion positioned above the cutting edge, and the first inner frame portion preferably includes a skin contact portion that is aligned with the skin contact portion of the first outer frame portion. Also, the second inner frame portion preferably includes a skin contact portion that is aligned with the skin contact portion of the second outer frame portion. The skin contact portion of the first outer frame portion, the skin contact portion of the first inner frame portion, the cutting edge of the blade body, the skin contact portion of the second outer frame portion, and the skin contact portion of the second inner frame portion are preferably arranged in the shaving plane.

In this case, when the razor is used, the razor head is further smoothly guided along the skin surface by the skin contact portions of the first outer frame portion and the second outer frame portion of the frame body and by the first inner frame portion and the second inner frame portion of the main body. This improves the shaving sensation.

The skin contact portion of the first outer frame portion and the skin contact portion of the first inner frame portion are preferably continuous with each other in the shaving plane, and the skin contact portion of the second outer frame portion and the skin contact portion of the second inner frame portion are preferably continuous with each other in the shaving plane.

In this case, the skin contact portion of the first outer frame portion and the skin contact portion of the first inner frame portion are continuous with each other such that the skin contact portions are in contact with each other or are adjacent to each other with a small gap in between in the shaving plane, and the skin contact portion of the second outer frame portion and the skin contact portion of the second inner frame portion are continuous with each other such that the skin contact portions are in contact with each other or are adjacent to each other with a small gap in between in the shaving plane. Thus, the skin contact portion of the first outer frame portion and the skin contact portion of the first inner frame portion are easily brought into contact with the skin surface simultaneously, and the skin contact portion of the second outer frame portion and the skin contact portion of the second inner frame portion are easily brought into contact with the skin surface simultaneously. Thus, when the razor is used, the razor head is further smoothly guided, improving the shaving sensation.

In addition to the first inner frame portion and the second inner frame portion, the main body preferably includes a third inner frame portion and a fourth inner frame portion, which connect the first inner frame portion and the second inner frame portion to each other on a left side and a right side of the cutting edge of the blade body to sandwich the blade body, and the cutting edge of the blade body is preferably exposed from an opening surrounded by the first to fourth inner frame portions. Also, each of the third outer frame portion and the fourth outer frame portion preferably includes a skin contact portion, and the third inner frame portion preferably includes a skin contact portion that is aligned with the skin contact portion of the third outer frame portion. Further, the fourth inner frame portion preferably includes a skin contact portion that is aligned with the skin contact portion of the fourth outer frame portion.

In this case, when the razor is used, the razor head is smoothly guided along the skin surface by the respective skin contact portions in the respective outer frame portions of the frame body and the respective inner frame portions of the main body. This improves the shaving sensation.

The skin contact portion of the third outer frame portion and the skin contact portion of the third inner frame portion are preferably continuous with each other in the shaving plane, and the skin contact portion of the fourth outer frame portion and the skin contact portion of the fourth inner frame portion are preferably continuous with each other in the shaving plane. The skin contact portion of the first outer frame portion, the skin contact portion of the first inner frame portion, the skin contact portion of the second outer frame portion, the skin contact portion of the second inner frame portion, the skin contact portion of the third outer frame portion, the skin contact portion of the third inner frame portion, the skin contact portion of the fourth outer frame portion, the skin contact portion of the fourth inner frame portion, and the cutting edge of the blade body are preferably arranged in the shaving plane.

In this case, the skin contact portion of the first outer frame portion and the skin contact portion of the first inner frame portion are easily brought into contact with the skin surface simultaneously, and the skin contact portion of the second outer frame portion and the skin contact portion of the second inner frame portion are easily brought into contact with the skin surface simultaneously. Furthermore, the skin contact portion of the third outer frame portion and the skin contact portion of the third inner frame portion are easily brought into contact with the skin surface simultaneously, and the skin contact portion of the fourth outer frame portion and the skin contact portion of the fourth inner frame portion are easily brought into contact with the skin surface simultaneously. Therefore, when the razor is used, the razor head is further smoothly guided. This improves the shaving sensation.

Each of the frame body and the main body preferably includes a stopper portion. When the main body is fitted in the opening of the frame body, the stopper portions preferably restrict movement of the frame body in a direction in which the main body is fitted and a direction opposite to the fitting direction. In this case, the stopper portions prevent the frame body and the main body from being separated unexpectedly.

The main body and the frame body each preferably include a front side, at which the cutting edge of the blade body is exposed, and a back side opposite to the front side, and each of the frame body and the main body preferably includes a stopper portion such that the main body is allowed to be fitted in the opening of the frame body with the back side of the frame body facing the front side of the main body. In this case, the stopper portions determine the direction in which the main body is fitted in the frame body, facilitating fitting of the main body into the frame body.

In the frame body, a shaving aid is preferably provided in at least one of the skin contact portion of the first outer frame portion and the skin contact portion of the second outer frame portion. In this case, a lubricating function of the shaving aid improves the shaving sensation.

In the main body, a recess portion adjacent to the shaving aid of the frame body is preferably provided in at least one of the skin contact portion of the first inner frame portion and the skin contact portion of the second inner frame portion. In this case, the shaving aid melted as a result of containing water or a shaving aid material such as shaving foam applied in advance to the skin accumulates in the recess portions and thus is easily held in the main body. This improves the shaving sensation.

In the frame body, a length of the shaving aid in a direction in which the cutting edge extends is preferably set to be greater than a length of the cutting edge of the blade body exposed in the main body. In this case, the lubricating function of the shaving aid is exerted through the entire cutting edge of the blade body. This improves the shaving sensation.

In the frame body, a shaving aid is preferably provided in each of the skin contact portion of the first outer frame portion and the skin contact portion of the second outer frame portion. In this case, the lubricating function of the shaving aid is further improved so that the shaving sensation is improved.

The shaving aid provided in each of the skin contact portion of the first outer frame portion and the skin contact portion of the second outer frame portion is preferably formed by injection molding. In this case, a shaving aid can easily be molded on each skin contact portion.

The present invention improves the shaving sensation by smooth guiding of the razor head on the skin surface when the razor is used.

DETAILED DESCRIPTION OF THE PREFERRED EMBODIMENTS

A razor according to one embodiment of the present invention will now be described with reference to the drawings.

Figure 1A:
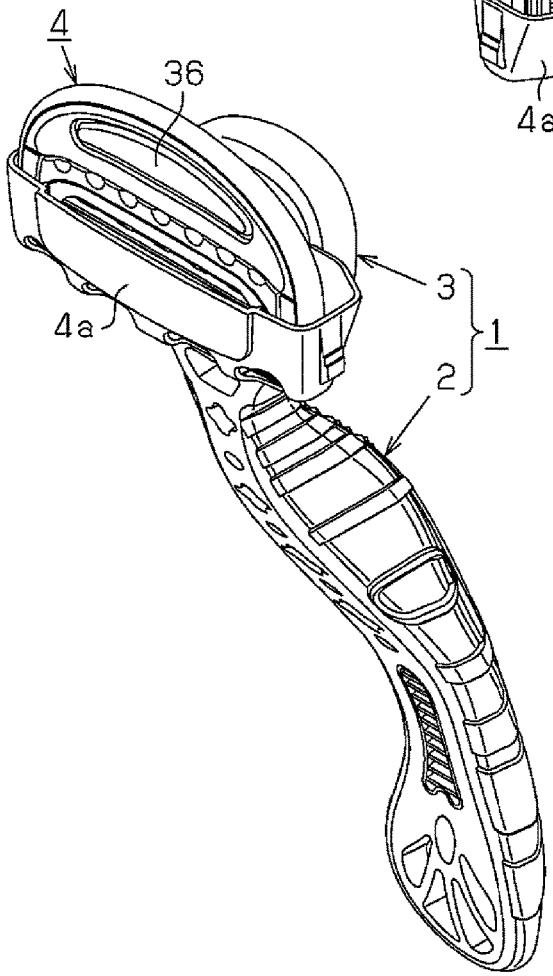
FIG. 1A is an overall front perspective view of a pivoting head razor with a cap fitted thereon at a neutral position of a razor head.
Figure 1B:
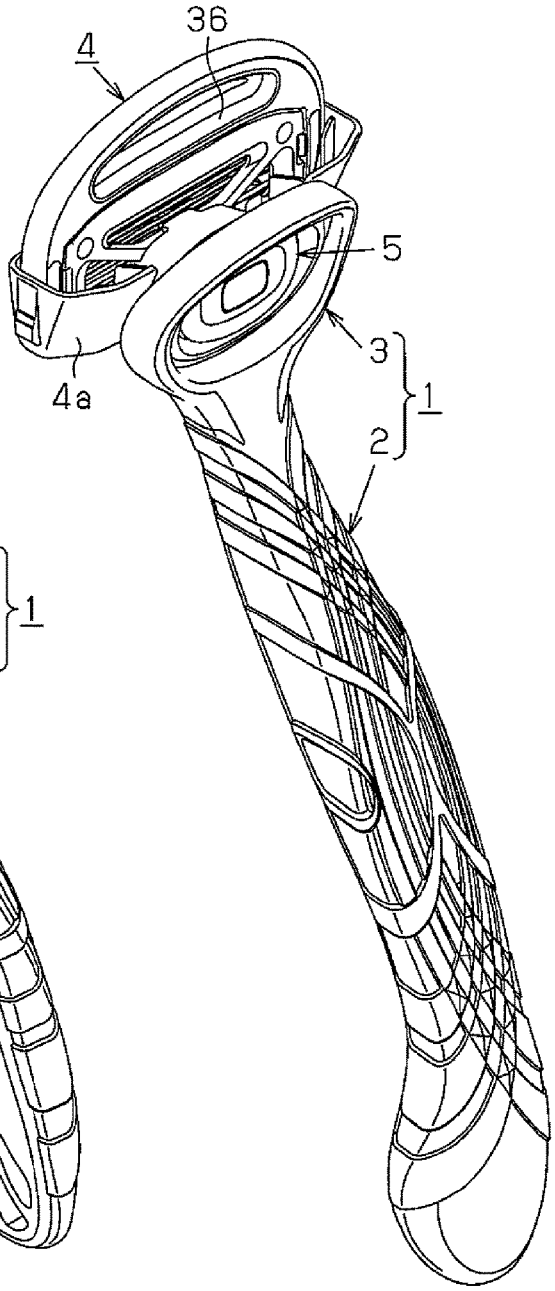
FIG. 1B is an overall rear perspective view of the pivoting head razor of FIG. 1A.

As illustrated in FIGS. 1A and 1B, a holder 1 of a razor includes a top portion 3 at an upper end portion of a handle 2. A razor head 4 is attached to a front surface of the top portion 3 via a pivoting mechanism 5. A cap 4*a* is fitted on the lower side of the razor head 4 such that the cap 4*a* can be removed upward from the lower side.

Figure 2B:
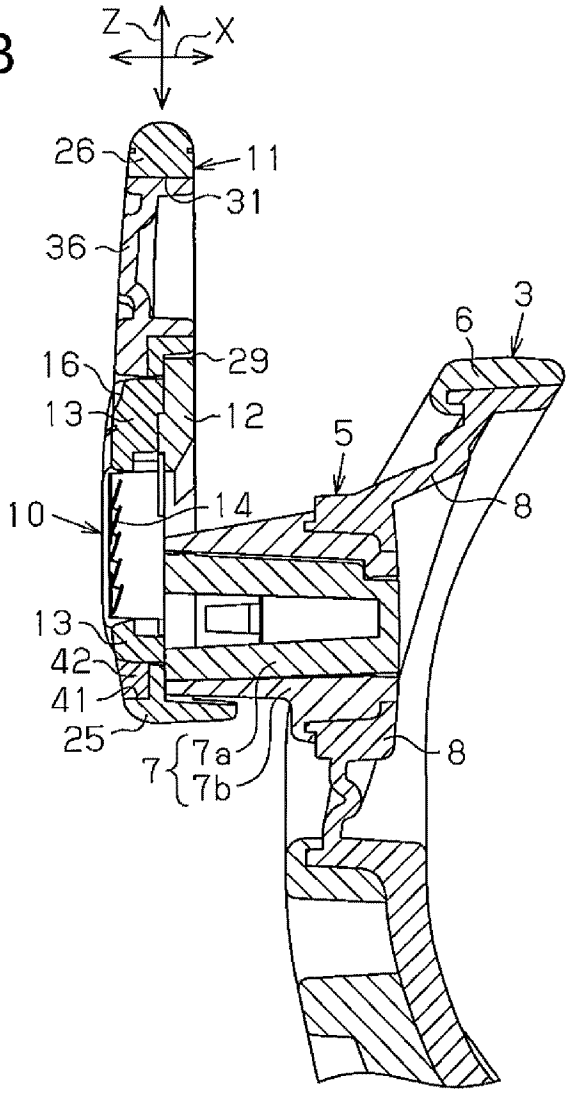
FIG. 2B is a partially enlarged cross-sectional side view of the pivoting head razor in FIG. 1A.
Figure 2A:
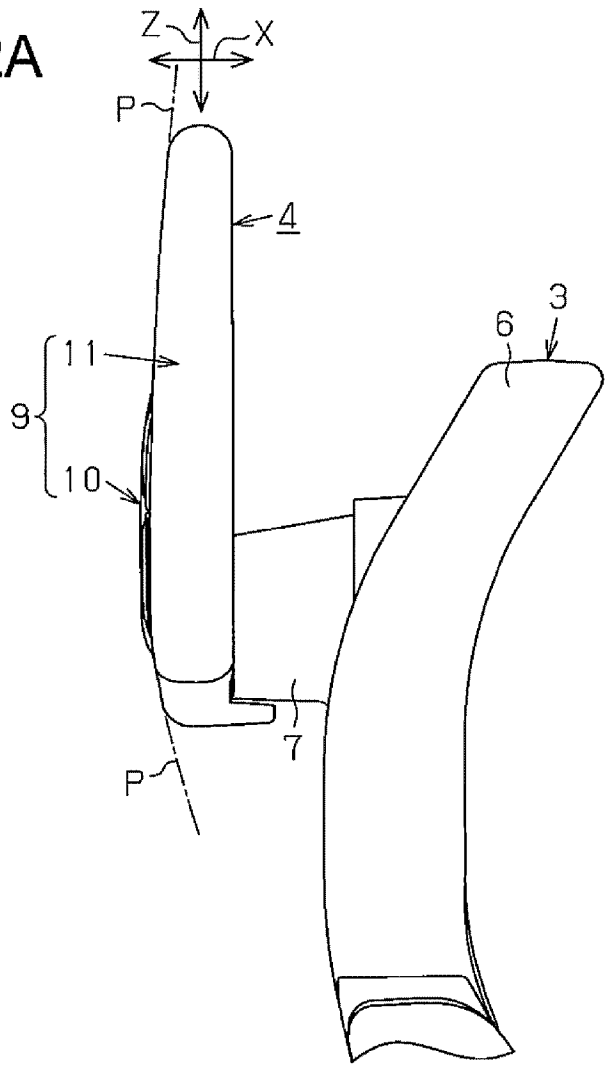
FIG. 2A is a partially enlarged side view illustrating a top portion of a holder and the razor head in the pivoting head razor of FIG. 1A.

As illustrated in FIGS. 2A and 2B, the pivoting mechanism 5 includes an annular supporting portion 6 provided at the top portion 3 of the holder 1 and a supported portion 7 provided at the razor head 4. An annular elastic portion 8 is provided between the supporting portion 6 and the supported portion 7, whereby the razor head 4 may take any pivoted position at which the razor head 4 is tilted in any three dimensional direction against pushing force of the elastic portion 8, from the neutral position, at which the razor head 4 holds as a result of being pushed by the elastic portion 8. The three dimensional directions include a direction in which the razor head 4 faces the front of the top portion 3.

Figure 3A:
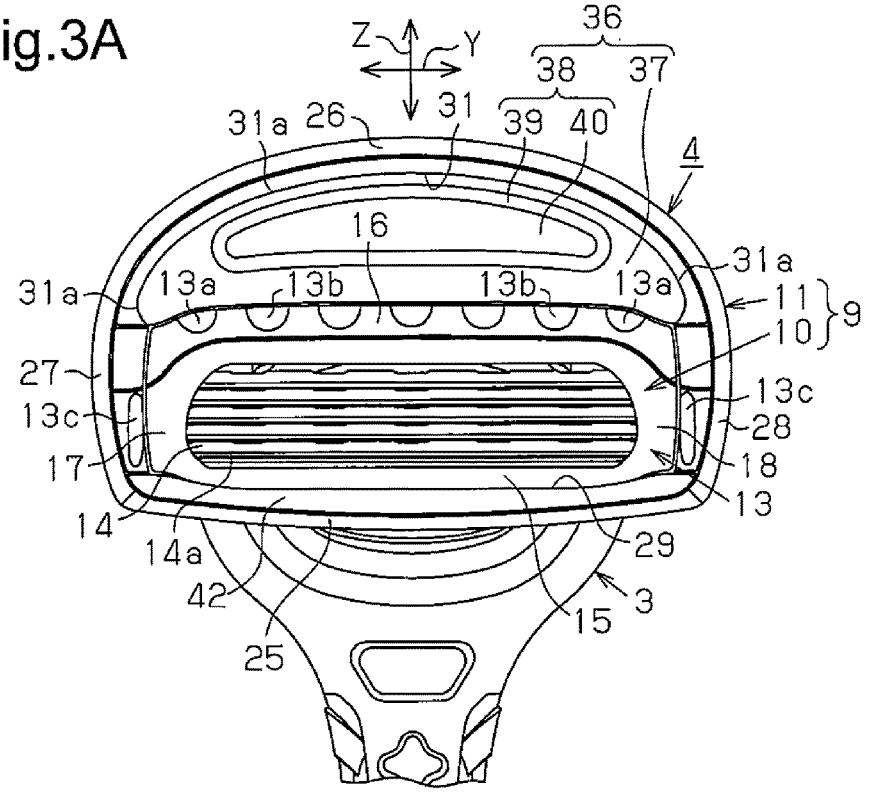
FIG. 3A is a partially enlarged front view illustrating the top portion of the holder and the razor head in the pivoting head razor of FIG. 1A.
Figure 3B:
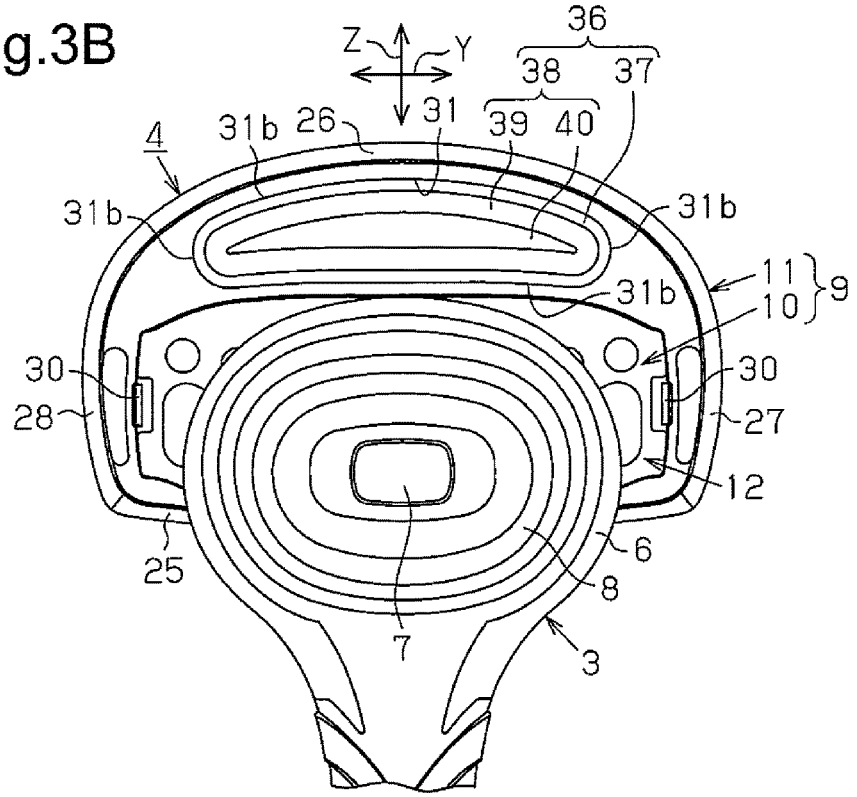
FIG. 3B is a partially enlarged rear view of the pivoting head razor of FIG. 1A.

As illustrated in FIGS. 2B, 3A and 3B, an attachment portion 9 provided in the razor head 4 includes a main body 10 and a frame body 11. In the main body 10 of the attachment portion 9, a plurality of blade bodies 14 are provided between a base portion 12 and a covering portion 13. The supported portion 7 includes a first coupling portion 7*a* provided to project rearward from the base portion 12, and a second coupling portion 7*b* attached to the elastic portion 8. The coupling portions 7*a* and 7*b* are mutually connected. Accordingly, the attachment portion 9 is connected to the top portion 3.

Figure 4A:
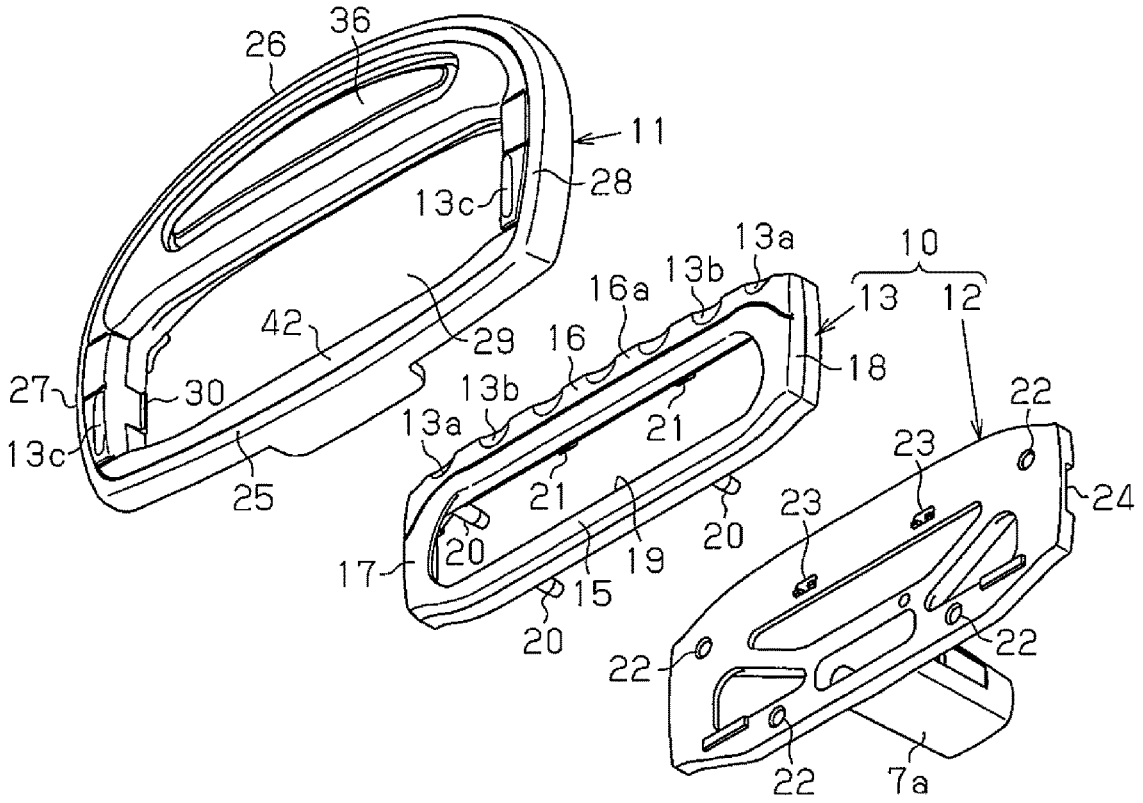
FIG. 4A is an exploded perspective view illustrating a main body (a base portion and a covering portion) and a frame body in the razor head.
Figure 4B:
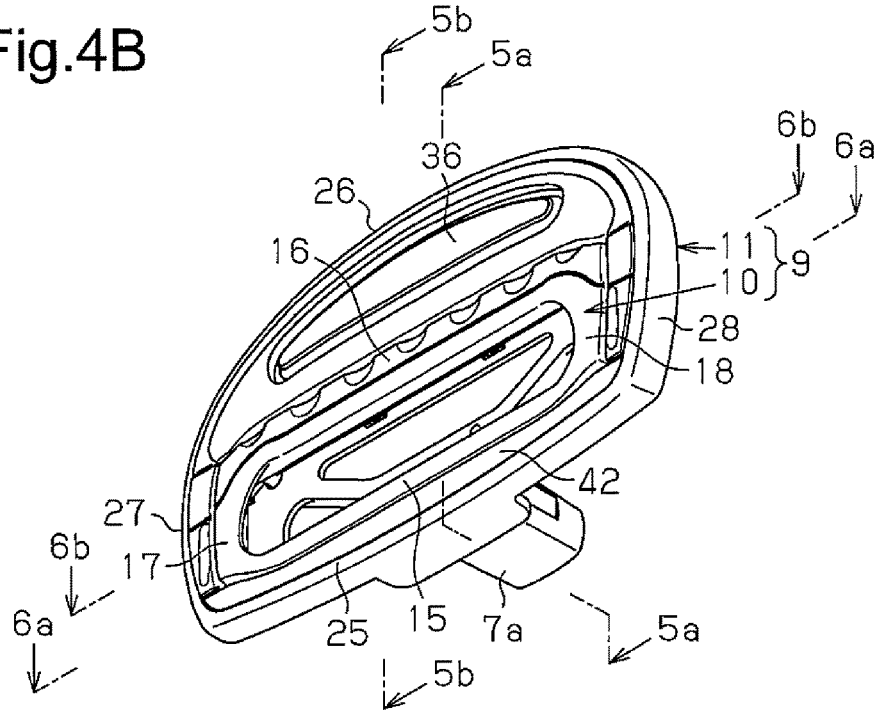
FIG. 4B is an assembled perspective view of the same.

As illustrated in FIGS. 4A and 4B, the covering portion 13 of the main body 10 includes a first inner frame portion 15 provided below the blade bodies 14 in a vertical direction Z, which is perpendicular to a direction Y in which a cutting edge 14*a* of each blade body 14 extends (lateral direction). The covering portion 13 also includes a second inner frame portion 16 provided above the blade bodies 14. Further, the covering portion 13 includes a left-side third inner frame portion 17 and a right-side fourth inner frame portion 18 connecting the lower first inner frame portion 15 and the upper second inner frame portion 16 to each other on the left side and right side of the blade bodies 14, respectively, and an opening 19 surrounded by the inner frame portions 15, 16, 17 and 18. The opening 19 opens in a front-rear direction X.

Figure 5A:
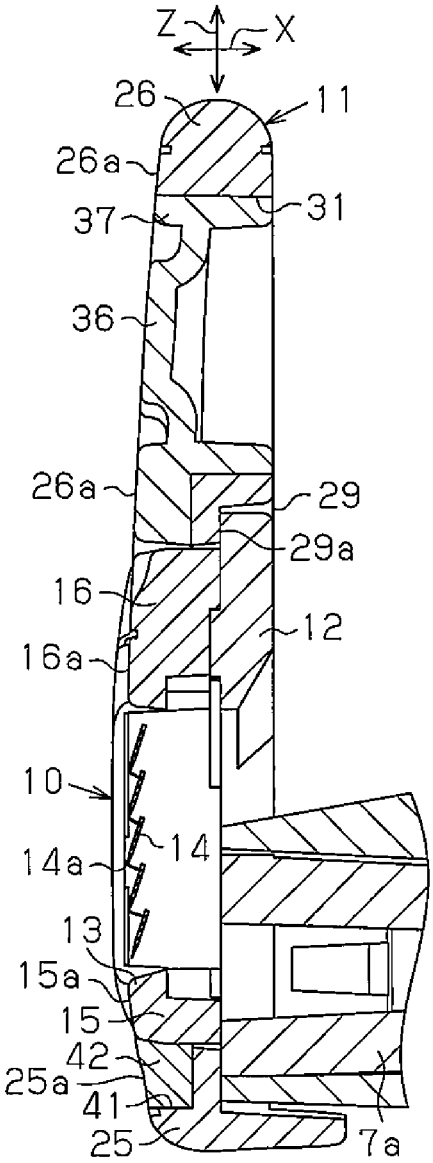
FIG. 5A is a partially enlarged cross-sectional view taken along line 5*a*-5*a* in FIG. 4B.
Figure 5B:
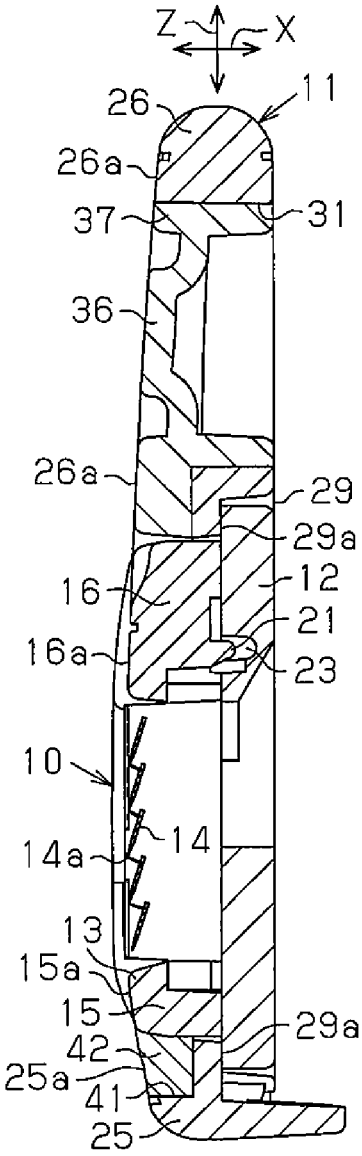
FIG. 5B is a partially enlarged vertical cross-sectional view taken along line 5*b*-5*b* in FIG. 4B.
Figure 6A:
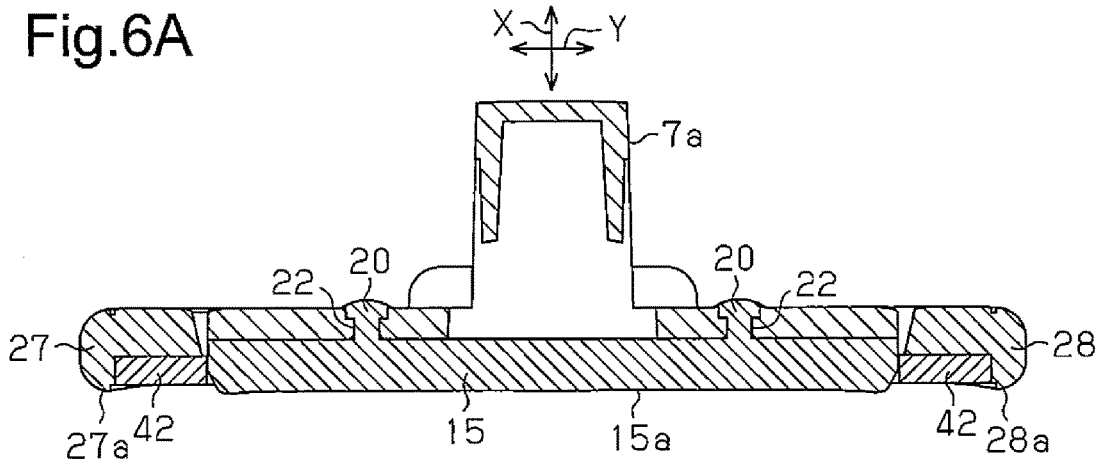
FIG. 6A is a partially enlarged cross-sectional view taken along line 6*a*-6*a* in FIG. 4B.

On the left and right sides of each of the first inner frame portion 15 and the second inner frame portion 16, stopper pins 20 are provided to project rearward. On the left and right sides of the second inner frame portion 16, a pair of locking protrusions 21 is provided between the left and right stopper pins 20 to project rearward. Also, in the base portion 12 of the main body 10, stopper holes 22 are formed on the left and right sides of each of an upper portion and a lower portion. On the left and right sides of the upper portion of the base portion 12, a pair of locking recess portions 23 is formed to be positioned between the left and right stopper holes 22, and a pair of locking recess portions 24 is formed in left and right parts of the base portion 12. When the rear side of the covering portion 13 and the front side of the base portion 12 are put together as illustrated in FIGS. 2B and 5A, the stopper pins 20 of the covering portion 13 are inserted into the respective stopper holes 22 of the base portion 12 as illustrated in FIGS. 2B and 6A, and the locking protrusions 21 of the covering portion 13 are inserted into the respective locking recess portions 23 of the base portion 12 as illustrated in FIGS. 2B and 5B, whereby the covering portion 13 and the base portion 12 are assembled in an integrated manner. The cutting edge 14*a* of each blade body 14 is exposed from the opening 19 of the covering portion 13.

As illustrated in FIGS. 4A and 4B, the frame body 11 of the attachment portion 9 includes a first outer frame portion 25 provided below the blade bodies 14 and a second outer frame portion 26 above the blade bodies 14, in the vertical direction Z, which is perpendicular to the direction Y, in which the cutting edge 14*a* of each blade body 14 extends (lateral direction). Also, the frame body 11 includes a left-side third outer frame portion 27 and a right-side fourth outer frame portion 28 connecting the lower first outer frame portion 25 and the upper second outer frame portion 26 on the left and right of the blade bodies 14, and an opening 29 surrounded by the outer frame portions 25, 26, 27 and 28. The opening 29 opens in the front-rear direction X. In each of the third and fourth outer frame portions 27 and 28, a locking protrusion 30 positioned at an inner periphery of the opening 29 is formed.

Figure 6B:
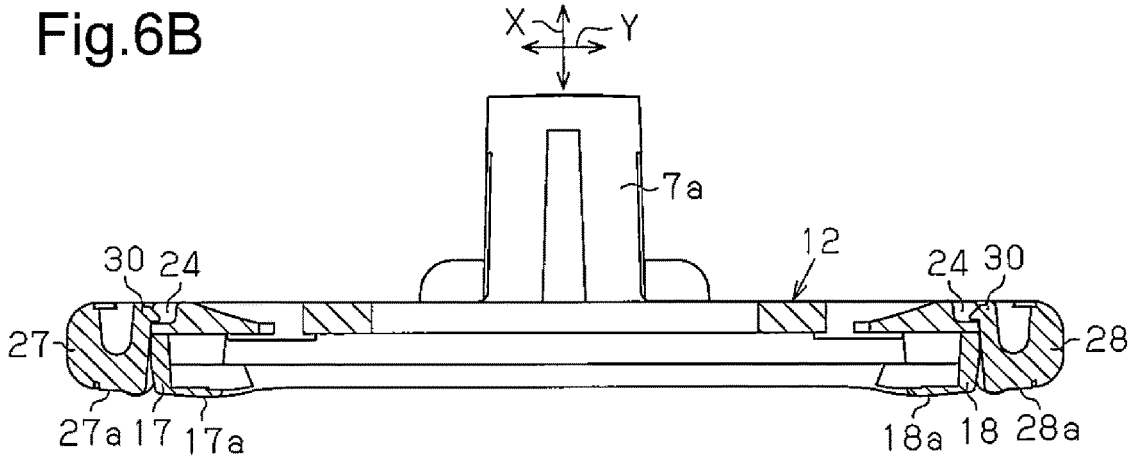
FIG. 6B is a partially enlarged cross-sectional view taken along line 6*b*-6*b* in FIG. 4B.

As illustrated in FIG. 5A, when the main body 10 is fitted in the opening 29 of the frame body 11 with the front side of the main body 10 facing the rear side (back side) of the frame body 11, the outer periphery of the main body 10 is surrounded by the inner periphery of the opening 29, and the front side of the covering portion 13 and the cutting edges 14*a* of the blade bodies 14 are exposed forward via the opening 29. In the fitted state, the main body 10 is locked by a step portion 29*a*, that is, a stopper portion formed at the inner periphery of the opening 29, whereby forward movement of the main body 10 is restricted. As illustrated in FIG. 6B, the left and right locking protrusions 30, that is, stopper portions, of the frame body 11 are engaged in the left and right locking recess portions 24, that is, stopper portions, of the base portion 12 of the main body 10, respectively, whereby the main body 10 is restricted from coming off the opening 29 in the front-rear direction X (including a direction of the fitting and a direction opposite to the direction of the fitting). Also, the outer periphery of the main body 10 is locked by the inner periphery of the opening 29, whereby movement of the main body 10 in the vertical direction Z and the lateral direction Y is restricted.

As illustrated in FIGS. 2B, 3A, 3B, 7 and 8, in the frame body 11, a through hole 31, which extends through the second outer frame portion 26 in the front-rear direction X, is formed in the upper second outer frame portion 26. In an inner periphery of the through hole 31, a lower inner portion 32, a left inner portion 33, a right inner portion 34, and an upper inner portion 35 are formed in the frame body 11 to be positioned between a front edge portion 31*a* and a rear edge portion 31*b*. In the left inner portion 33 and the right inner portion 34, a left inner surface 33*a* and a right inner surface 34*a* each having a stepped surface 33*b* or 34*b* are formed, respectively. In the upper inner portion 35, an upper inner surface 35*a* is formed over the entire area between the front edge portion 31*a* and the rear edge portion 31*b* and is formed so as to be continuous with the left inner surface 33*a* and the right inner surface 34*a*. In the lower inner portion 32, a lower inner surface 32*a*, and a stepped surface 32*b*, which forms a step between the inner surface 32*a* and an upper side of the covering portion 13 of the main body 10, are formed.

Between the front edge portion 31*a* and the rear edge portion 31*b*, which extend annularly over the inner portions 32, 33, 34 and 35 of the through hole 31, a shaving aid 36 is attached to be integrated with the frame body 11 of the attachment portion 9 by injection molding. The shaving aid 36 is molded such that the shaving aid 36 contains a water-soluble component such as water-soluble polyethylene oxide, and a water insoluble component containing a soft plastic such as an elastomer resin. The weight ratio of the soft plastic, which is a water insoluble component, in the whole shaving aid 36 is set to be greater than the weight ratio of the water-soluble component in the whole shaving aid 36. The weight ratio of the elastomer resin is set to be 30% or more (in the embodiment, 50% or more), and the weight ratio of the water-soluble component is set to be 50% or less (in the embodiment, 15%).

The main body 10 and the frame body 11 of the attachment portion 9 and the supported portion 7, other than the blade bodies 14, in the razor head 4 are molded with synthetic resin.

Figure 7:
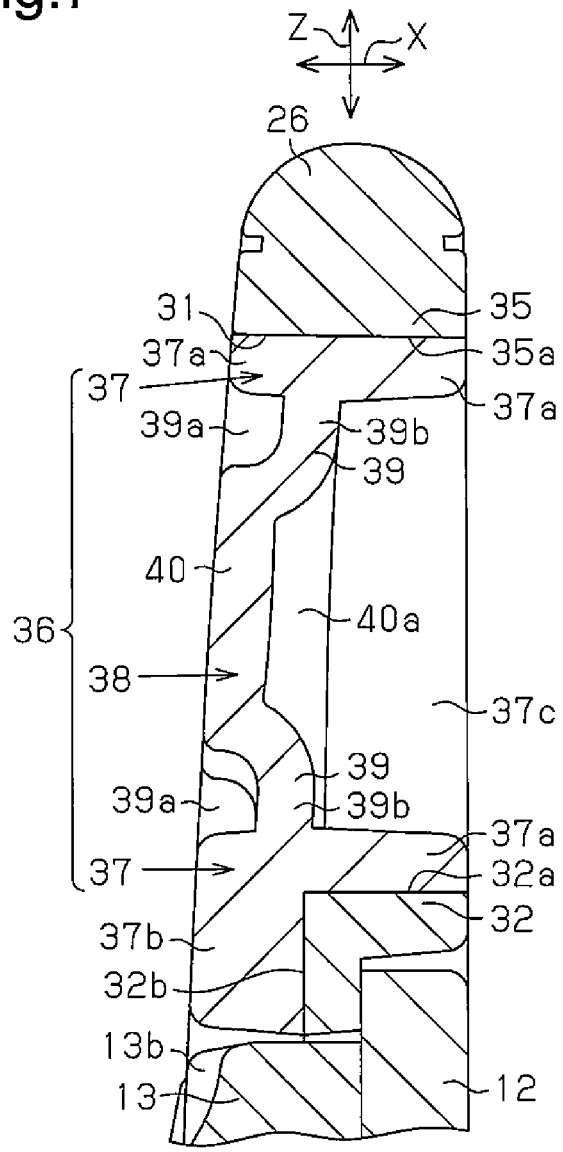
FIG. 7 is a partially enlarged vertical cross-sectional view illustrating only the upper shaving aid from the upper and lower shaving aids illustrated in FIG. 3A.
Figure 8:
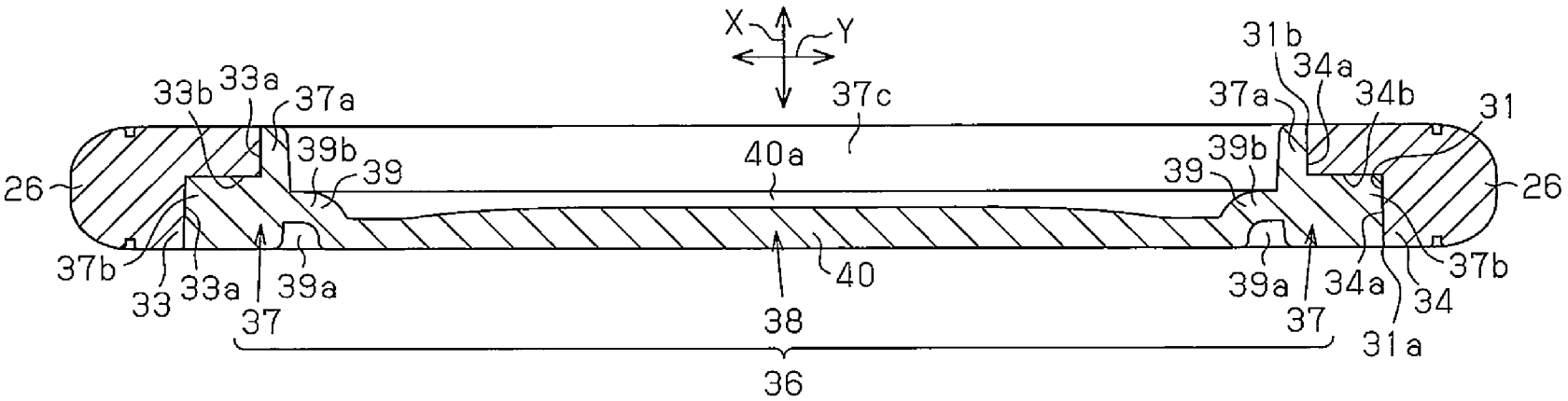
FIG. 8 is a partially enlarged horizontal cross-sectional view of the upper shaving aid.

The shaving aid 36 includes an annular supporting portion 37 attached to the inner surfaces 32*a*, 33*a*, 34*a* and 35*a* and the stepped surfaces 32*b*, 33*b* and 34*b*, and a non-support portion 38 formed inside the supporting portion 37, in the inner portions 32, 33, 34 and 35 around the through hole 31. The supporting portion 37 and the non-support portion 38 are integrally molded and are exposed in the front-rear direction X (thickness direction) from the through hole 31. The supporting portion 37 of the shaving aid 36 includes a first coupling portion 37*a* attached to the inner surfaces 32*a*, 33*a*, 34*a* and 35*a*, and a second coupling portion 37*b* attached to the stepped surfaces 32*b*, 33*b* and 34*b*. As illustrated in FIG. 7, the second coupling portion 37*b* on the stepped surface 32*b* is adjacent to the upper side of the covering portion 13 of the main body 10. Inside the supporting portion 37, a cavity 37*c*, which is positioned on the rear side of the non-support portion 38, is formed. The non-support portion 38 includes a deformable portion 39 annularly formed at a part that borders the supporting portion 37 and a movable portion 40 formed inside the deformable portion 39. The deformable portion 39 includes an annular groove portion 39*a* (expansion reduction portion), and an annular thin portion 39*b* (flexible part) formed by the groove portion 39*a*.

The movable portion 40 is caused to expand forward by a cavity 40*a* formed inside the thin portion 39*b* along the inner periphery of the thin portion 39*b*, and is surrounded by the groove portion 39*a*. On a plane including the front edge portion 31*a* of the through hole 31, the first and second coupling portions 37*a* and 37*b* of the supporting portion 37 and the movable portion 40 of the non-support portion 38 are positioned. On a plane including the rear edge portion 31*b* of the through hole 31, the first coupling portion 37*a* of the supporting portion 37 is positioned. The maximum thickness of the non-support portion 38 is set to be smaller than the maximum thickness of the supporting portion 37. The width in the vertical direction Z of the shaving aid 36, which crosses the direction Y, in which the cutting edges 14*a* extend (lateral direction), is set to decrease toward the left and right sides of the shaving aid 36, and is set to be largest at a middle part of the shaving aid 36.

As illustrated in FIGS. 4A, 4B, 5A, 5B and 7, in the front side of the covering portion 13 of the main body 10 and the front side of the frame body 11, the cutting edges 14*a* of the blade bodies 14, the upper inner frame portion 16, and the shaving aid 36 are sequentially arranged alongside toward the top. On each of the left and right sides of the upper inner frame portion 16, one recess portion 13*a* is formed. Between the left and right recess portions 13*a*, a plurality of recess portions 13*b* is formed. The recess portions 13*a* and 13*b* are provided side by side along the front edge portion 31*a* of the through hole 31 and in the lateral direction Y, and open toward the supporting portion 37 of the shaving aid 36. Although not illustrated, a part of a front surface of the covering portion 13, in which the middle recess portions 13*b* are formed, is located at a position slightly displaced rearward from the part of the front surface of the covering portion 13 at which the left and right recess portions 13*a* are formed. Thus, the water-soluble component melting from the shaving aid 36 and a shaving aid material such as shaving foam applied in advance to the skin more easily enter and accumulate in the middle recess portions 13*b* than the left and right recess portions 13*a*.

As illustrated in FIG. 3A, a belt-like protrusion 13*c* extending in the vertical direction Z is formed on each of the left and right sides of the covering portion 13 of the main body 10. The top surface of each protrusion 13*c* is substantially positioned on a plane including the cutting edge 14*a* of each blade body 14. In use, the left and right protrusions 13*c* are brought into contact with the skin surface together with the respective cutting edges 14*a* and guide the razor head 4 in the vertical direction Z while stabilizing the razor head 4.

In the frame body 11, the length of each of the shaving aids 36 and 42 in the direction Y, in which the cutting edges 14*a* extend, is set to be greater than the length of the cutting edge 14*a* of each blade body 14, which is exposed from the covering portion 13 of the main body 10.

Also, as illustrated in FIGS. 4A and 5A, the shaving aid 42 is injection molded on a step portion 41 formed in the lower first outer frame portion 25 of the frame body 11 to be integrally attached to the frame body 11 of the attachment portion 9. The shaving aid 42 on the step portion 41 is adjacent to the lower side of the covering portion 13 of the main body 10. The shaving aid 42 on the step portion 41 of the first outer frame portion 25 is injection molded simultaneously with the shaving aid 36 on the upper second outer frame portion 26.

In FIGS. 3A and 3B, the maximum dimension in the lateral direction Y and the maximum dimension in the vertical direction Z of the attachment portion 9 (the main body 10 and the frame body 11) of the razor head 4 are set to approximately 48 mm and approximately 30 mm, respectively. Also, in FIG. 7, the maximum thickness of the supporting portion 37 of the shaving aid 36 is set to approximately 3 mm. The maximum thickness of each of the thin portion 39*b* and the movable portion 40 of the non-support portion 38 of the shaving aid 36 is set to approximately 0.8 mm, and is preferably set to 0.5 to 1.5 mm.

As illustrated in FIGS. 3A, 5A, 5B, 6A and 6B, in the frame body 11, skin contact portions 25*a*, 26*a*, 27*a* and 28*a* are formed at the front side of the first outer frame portion 25, the front side of the second outer frame portion 26, the front side of the third outer frame portion 27 and the front side of the fourth outer frame portion 28, respectively. The skin contact portion 26*a* of the second outer frame portion 26 includes a part of the shaving aid 36. The skin contact portion 25*a* of the first outer frame portion 25 includes a part of the shaving aid 42. As illustrated in FIGS. 3A, 5A, 5B, 6A and 6B, in the covering portion 13 of the main body 10, skin contact portions 15*a*, 16*a*, 17*a* and 18*a* are formed at the front side of the first inner frame portion 15, the front side of the second inner frame portion 16, the front side of the third inner frame portion 17 and the front side of the fourth inner frame portion 18, respectively.

The skin contact portion 25*a* of the first outer frame portion 25, the skin contact portion 15*a* of the first inner frame portion 15, the skin contact portion 26*a* of the second outer frame portion 26, the skin contact portion 16*a* of the second inner frame portion 16, the skin contact portion 27*a* of the third outer frame portion 27, the skin contact portion 17*a* of the third inner frame portion 17, the skin contact portion 28*a* of the fourth outer frame portion 28, the skin contact portion 18*a* of the fourth inner frame portion 18, and the cutting edge 14*a* of each blade body 14 are located on a slightly-curved shaving plane P as illustrated in FIG. 2A. The skin contact portion 15*a* of the first inner frame portion 15 is continuous with and arranged alongside of the skin contact portion 25*a* of the first outer frame portion 25 in the shaving plane P, and the skin contact portion 15*a* and the skin contact portion 25*a* are in contact with each other or are adjacent to each other with a small gap in between. The skin contact portion 16*a* of the second inner frame portion 16 is continuous with and arranged alongside of the skin contact portion 26*a* of the second outer frame portion 26 in the shaving plane P, and the skin contact portion 16*a* and the skin contact portion 26*a* are in contact with each other or are adjacent to each other with a small gap in between. As illustrated in FIG. 6B, the skin contact portion 17*a* of the third inner frame portion 17 is continuous with and arranged alongside of the skin contact portion 27*a* of the third outer frame portion 27 in the shaving plane P, and the skin contact portion 17*a* and the skin contact portion 27*a* are in contact with each other or are adjacent to each other with a small gap in between. The skin contact portion 18*a* of the fourth inner frame portion 18 is continuous with and arranged alongside of the skin contact portion 28*a* of the fourth outer frame portion 28 in the shaving plane P, and the skin contact portion 18*a* and the skin contact portion 28*a* are in contact with each other, or are adjacent to each other with a small gap in between.

Operation of the Razor will Now be Described.

When, in use, the razor head 4 at the neutral position is pressed against the skin surface in the shaving plane P to shave skin hairs, the razor head 4 is tilted against the pushing force of the elastic portion 8 of the pivoting mechanism 5 in accordance with the direction in which the razor head 4 is pressed, thereby reducing the resistance when shaving skin hairs. Since the shaving aids 36 and 42 of the razor head 4 are put on the skin surface in a state in which the shaving aids 36 and 42 contain water, running of the razor head 4 is improved, improving the shaving sensation. In the shaving aid 36, which includes the deformable portion 39, deformation may occur in the groove portion 39*a* and the thin portion 39*b* as a result of contact with the skin surface. Thus, the tactile sensation with respect to the skin surface is improved, and the direction of the expanding deformation as a result of containing water split to the inside of the groove portion 39*a* and the front and back sides of the thickness, and thus, contact with the skin surface as a result of the expanding deformation is moderated. This further improves the shaving sensation.

The present embodiment has the following advantages.

(1) In the frame body 11, the first outer frame portion 25 and the second outer frame portion 26 are connected to each other by the third outer frame portion 27 and the fourth outer frame portion 28 on the opposite sides of the cutting edges 14*a* in the main body 10, whereby the main body 10 is surrounded by the respective outer frame portions 25, 26, 27 and 28. Consequently, the rigidity of the frame body 11 is increased, which stabilizes the shaving plane P, which connects the skin contact portion 25*a* of the first outer frame portion 25, the cutting edge 14*a* of each blade body 14 and the skin contact portion 26*a* of the second outer frame portion 26. Accordingly, when the razor is used, the razor head 4 is smoothly guided, improving the shaving sensation.

(2) The shaving plane P connects the skin contact portion 25*a* of the first outer frame portion 25, the skin contact portion 15*a* of the first inner frame portion 15, the skin contact portion 26*a* of the second outer frame portion 26, the skin contact portion 16*a* of the second inner frame portion 16, the skin contact portion 27*a* of the third outer frame portion 27, the skin contact portion 17*a* of the third inner frame portion 17, the skin contact portion 28*a* of the fourth outer frame portion 28, the skin contact portion 18*a* of the fourth inner frame portion 18, and the cutting edge 14*a* of each blade body 14. When the razor is used, the skin contact portions 25*a*, 26*a*, 27*a*, 28*a*, 15*a*, 16*a*, 17*a* and 18*a* and the cutting edges 14*a* come into contact with a skin surface sequentially or simultaneously in the shaving plane P. Thus, when the razor is used, the razor head 4 is smoothly guided, improving the shaving sensation.

(3) The skin contact portion 25*a* of the first outer frame portion 25 and the skin contact portion 15*a* of the first inner frame portion 15 are formed to be continuous with each other in the shaving plane P. The skin contact portion 26*a* of the second outer frame portion 26 and the skin contact portion 16*a* of the second inner frame portion 16 are formed to be continuous with each other in the shaving plane P. The skin contact portion 27*a* of the third outer frame portion 27 and the skin contact portion 17*a* of the third inner frame portion 17 are formed to be continuous with each other in the shaving plane P. The skin contact portion 28*a* of the fourth outer frame portion 28 and the skin contact portion 18*a* of the fourth inner frame portion 18 are formed to be continuous with each other in the shaving plane P. Thus, when the razor is used, the razor head 4 is smoothly guided, improving the shaving sensation.

The above illustrated embodiment may be modified as follows.

In the above illustrated embodiment, the pivoting mechanism 5 may be omitted, and the razor head 4 may be supported to be unable to pivot with respect to the top portion 3 of the holder 1.

In the above illustrated embodiment, the shaving aid 36 of the razor head 4 may be omitted.

The shaving aids 36 and 42 may be each provided on a part other than the razor head 4, for example, the holder 1 or the cap 4*a*.

In the attachment portion 9 of the razor head 4, it is possible that a plurality of frame bodies 11 is provided for one main body 10 to change frame bodies 11. Alternatively, a plurality of main bodies 10 may be provided for one frame body 11 to change main bodies 10.

DESCRIPTION OF THE REFERENCE NUMERALS

4 . . . razor head, 9 . . . attachment portion of razor head, 10 . . . main body of attachment portion, 11 . . . frame body of attachment portion, 13*a*, 13*b* . . . recess portion of main body, 14 . . . blade body of attachment portion, 14*a* . . . cutting edge, 15 . . . first inner frame portion of main body, 15*a* . . . skin contact portion, 16 . . . second inner frame portion of main body, 16*a* . . . skin contact portion, 17 . . . third inner frame portion of main body, 17*a* . . . skin contact portion, 18 . . . fourth inner frame portion of main body, 18*a* . . . skin contact portion, 19 . . . opening of main body, 24 . . . lacking recess portion (stopper portion) of main body, 25 . . . first outer frame portion of frame body, 25*a* . . . skin contact portion, 26 . . . second outer frame portion of frame body, 26*a* . . . skin contact portion, 27 . . . third outer frame portion of frame body, 27*a* . . . skin contact portion, 28 . . . fourth outer frame portion of frame body, 28*a* . . . skin contact portion, 29 . . . opening of frame body, 29*a* . . . step portion, 30 . . . locking projection portion (stopper portion) of frame body, 36, 42 . . . shaving aid, P . . . shaving plane of attachment portion, Y . . . direction of extension of cutting edge.

The invention claimed is:

1. A razor comprising:

a main body including a blade body; and a frame body attached to the main body, wherein:

the frame body includes:

a first outer frame portion provided below a cutting edge of the blade body;

a second outer frame portion provided above the cutting edge;

a third outer frame portion and a fourth outer frame portion, which connect the first outer frame portion and the second outer frame portion to each other on a left side and a right side of the blade body, respectively;

an opening surrounded by the first to fourth outer frame portions; and a skin contact portion provided on each of the first outer frame portion and the second outer frame portion, the main body is fitted in the opening to be surrounded by the outer frame portions; and the skin contact portion of the first outer frame portion, the cutting edge of the blade body, and the skin contact portion of the second outer frame portion being connected by a shaving plane, wherein the main body includes a first inner frame portion positioned below the cutting edge of the blade body and a second inner frame portion positioned above the cutting edge;

the first inner frame portion includes a skin contact portion that is aligned with the skin contact portion of the first outer frame portion;

the second inner frame portion includes a skin contact portion that is aligned with the skin contact portion of the second outer frame portion; and the skin contact portion of the first outer frame portion, the skin contact portion of the first inner frame portion, the cutting edge of the blade body, the skin contact portion of the second outer frame portion, and the skin contact portion of the second inner frame portion are arranged in the shaving plane, in addition to the first inner frame portion and the second inner frame portion, the main body includes a third inner frame portion and a fourth inner frame portion, which connect the first inner frame portion and the second inner frame portion to each other on a left side and a right side of the cutting edge of the blade body to sandwich the blade body;

the cutting edge of the blade body is exposed from an opening surrounded by the first to fourth inner frame portions;

each of the third outer frame portion and the fourth outer frame portion includes a skin contact portion;

the third inner frame portion includes a skin contact portion that is aligned with the skin contact portion of the third outer frame portion; and the fourth inner frame portion includes a skin contact portion that is aligned with the skin contact portion of the fourth outer frame portion, the skin contact portion of the third outer frame portion and the skin contact portion of the third inner frame portion are continuous with each other in the shaving plane;

the skin contact portion of the fourth outer frame portion and the skin contact portion of the fourth inner frame portion are continuous with each other in the shaving plane; and the skin contact portion of the first outer frame portion, the skin contact portion of the first inner frame portion, the skin contact portion of the second outer frame portion, the skin contact portion of the second inner frame portion, the skin contact portion of the third outer frame portion, the skin contact portion of the third inner frame portion, the skin contact portion of the fourth outer frame portion, the skin contact portion of the fourth inner frame portion, and the cutting edge of the blade body are arranged in the shaving plane, in the frame body, a shaving aid is provided in at least one of the skin contact portion of the first outer frame portion and the skin contact portion of the second outer frame portion, the skin contact portion of the second outer frame portion has a through hole, the shaving aid includes an annular supporting portion attached to inner surfaces, and a non-support portion formed inside the supporting portion, in inner portions around the through hole, the non-support portion includes a deformable portion annularly formed at a part that borders the supporting portion and a movable portion formed inside the deformable portion, the deformable portion includes an annular groove portion and an annular thin portion formed by the groove portion, the movable portion is caused to expand forward by a cavity formed inside the thin portion along an inner periphery of the thin portion, and is surrounded by the groove portion.

2. The razor according to claim 1, wherein:

the skin contact portion of the first outer frame portion and the skin contact portion of the first inner frame portion are continuous with each other in the shaving plane; and the skin contact portion of the second outer frame portion and the skin contact portion of the second inner frame portion are continuous with each other in the shaving plane.

3. The razor according to claim 1, wherein:

each of the frame body and the main body includes a stopper portion; and when the main body is fitted in the opening of the frame body, the stopper portions restrict movement of the frame body in a direction in which the main body is fitted and a direction opposite to the fitting direction.

4. The razor according to claim 1, wherein:

the main body and the frame body each include a front side, at which the cutting edge of the blade body is exposed, and a back side opposite to the front side; and each of the frame body and the main body includes a stopper portion such that the main body is allowed to be fitted in the opening of the frame body with the back side of the frame body facing the front side of the main body.

5. The razor according to claim 1, wherein, in the main body, a recess portion adjacent to the shaving aid of the frame body is provided in at least one of the skin contact portion of the first inner frame portion and the skin contact portion of the second inner frame portion.

6. The razor according to claim 1, wherein, in the frame body, a length of the shaving aid in a direction in which the cutting edge extends is set to be greater than a length of the cutting edge of the blade body exposed in the main body.

7. The razor according to claim 1, wherein, in the frame body, a shaving aid is provided in each of the skin contact portion of the first outer frame portion and the skin contact portion of the second outer frame portion.

8. The razor according to claim 7, wherein the shaving aid provided in each of the skin contact portion of the first outer frame portion and the skin contact portion of the second outer frame portion is formed by injection molding.

* * * * *